US008115409B2

(12) United States Patent
Lin et al.

(10) Patent No.: US 8,115,409 B2
(45) Date of Patent: Feb. 14, 2012

(54) DRIVING CIRCUIT AND METHOD OF BACKLIGHT MODULE

(75) Inventors: Chi-Hsiu Lin, Yun-Lin Hsien (TW); Shin-Chang Lin, Taipei Hsien (TW); Chien-Yang Chen, Taipei (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 475 days.

(21) Appl. No.: 12/424,535

(22) Filed: Apr. 15, 2009

(65) Prior Publication Data

US 2009/0322243 A1 Dec. 31, 2009

(30) Foreign Application Priority Data

Jun. 26, 2008 (TW) ..... 97123906 A

(51) Int. Cl.
*H05B 37/02* (2006.01)

(52) U.S. Cl. ..... 315/291; 345/102; 315/244; 315/283; 315/306

(58) Field of Classification Search ..... 315/209 R, 315/224, 225, 227 R, 244, 246, 283, 291, 315/306; 345/102
See application file for complete search history.

(56) References Cited

U.S. PATENT DOCUMENTS

| | | | | |
|---|---|---|---|---|
| 5,049,789 | A * | 9/1991 | Kumar et al. | 315/289 |
| 5,670,849 | A * | 9/1997 | Melai | 315/307 |
| 5,920,155 | A * | 7/1999 | Kanda et al. | 315/307 |
| 7,002,819 | B1 * | 2/2006 | Chan et al. | 363/132 |
| 2003/0122500 | A1 * | 7/2003 | Liang et al. | 315/224 |

* cited by examiner

*Primary Examiner* — Thuy Vinh Tran
(74) *Attorney, Agent, or Firm* — Winston Hsu; Scott Margo

(57) ABSTRACT

A driving circuit includes a signal generator, a resonant circuit, a control circuit and an adjusting circuit. The signal generator is utilized for generating an alternating current (AC) signal having a fixed frequency. The resonant circuit is coupled to the signal generator, and is utilized for generating an oscillation signal to drive a backlight source according to the alternating current signal. The control circuit is utilized for providing a control signal. The adjusting circuit is coupled to the control circuit, the resonant circuit and the backlight source, and is utilized for providing an impedance according to the control signal to thereby adjust a current value of the backlight source.

14 Claims, 5 Drawing Sheets

DRIVING CIRCUIT AND METHOD OF BACKLIGHT MODULE

BACKGROUND OF THE INVENTION

1. Field of the Invention

The present invention relates to a driving mechanism of a backlight module, and more particularly, to a luminance-adjusting driving circuit and related method of a backlight module using a hot cathode fluorescent lamp (HCFL).

2. Description of the Prior Art

For a display apparatus having a backlight module, such as a liquid crystal display (LCD), an appropriate luminance-adjusting mechanism is required for adjusting the luminance of a backlight source due to the considerations of an ambient light intensity and a user's preferences.

When a hot cathode fluorescent lamp (HCFL) serves as the backlight source, a frequency modulation control, an amplitude modulation control, or a pulse width modulation (PWM) control is generally used as the luminance-adjusting method of a driving circuit. A driving circuit for performing the frequency modulation control is easy to design, and is able to adjust the luminance of the backlight source efficiently. However, because of a frequency variation of a control signal of this driving circuit, a design of a front-end filter is difficult due to the electro-magnetic interference (EMI), and magnetic components cannot be optimally applied in the driving circuit. Furthermore, the amplitude modulation control adjusts the luminance by changing a DC current of a resonant circuit, and the design of the driving circuit is more difficult. The PWM control adjusts the luminance by adjusting an enabling period of a switch. Generally, a symmetrical PWM control is used as the PWM control, although the driving circuit of the PWM control is more complex than that of the frequency modulation control, and has a higher power consumption because of switching operations.

Please refer to FIG. 1. FIG. 1 is a diagram illustrating a prior art quasi-half-bridge frequency-varied driving circuit 100. The driving circuit 100 includes a DC current source Vdc, a signal generator 110, a resonant circuit 120 coupled to the signal generator 110, a capacitor 140 coupled to the resonant circuit 120 and a backlight source 130, and two capacitors 160 and 170 coupled to the signal generator 110 and the backlight source 130. The signal generator 110 is used for generating an alternating current (AC) signal having a variable frequency. The resonant circuit 120 is used for generating an oscillation signal to drive the backlight source 130 according to the AC signal. The capacitor 140 is used to provide an impedance to adjust a current value of the backlight source 130. The capacitors 160 and 170 are used to generate a DC voltage level. In addition, the signal generator 110 includes two transistors 112 and 114, and the frequency of the AC signal can be determined by adjusting a frequency of switching on/off the transistors 112 and 114. The resonant circuit 120 includes an inductor 122 and a capacitor 124, which is used to convert the AC signal generated from the signal generator 110 to a sinusoidal wave to drive the backlight source 130.

As shown in FIG. 1, the capacitor 140 is connected in parallel to the backlight source 130. When the AC signal generated from the signal generator 110 has a frequency $\omega$, the impedance of the capacitor 140 is $(1/\omega C_f)$, where $C_f$ is a capacitance of the capacitor 140. Then, the current of the backlight source 130 is determined according to a ratio between the impedance of the capacitor 140 and an impedance of the backlight source 130. When the impedance of the capacitor 140 is greater than the impedance of the backlight source 130, the backlight source 130 is in the main current path and the backlight source 130 lightens; and when the impedance of the capacitor 140 is less than the impedance of the backlight source 130, the capacitor 140 is in the main current path and the luminance of the backlight source 130 is degraded or even extinguished.

A circuit structure of the above-mentioned luminance-adjusting method is simple, however, the front-end filter will be interfered with by the electro-magnetic wave due to the frequency variation, and the magnetic components cannot be optimally applied in the driving circuit.

SUMMARY OF THE INVENTION

It is therefore an objective of the present invention to provide a luminance-adjusting driving circuit and related method, which uses an AC signal having a fixed frequency to drive the backlight source, in order to solve the above-mentioned problems.

According to one embodiment of the present invention, a driving circuit includes a signal generator, a resonant circuit, a control circuit and an adjusting circuit. The signal generator is utilized for generating an alternating current (AC) signal having a fixed frequency. The resonant circuit is coupled to the signal generator, and is utilized for generating an oscillation signal to drive a backlight source according to the alternating current signal. The control circuit is utilized for providing a control signal. The adjusting circuit is coupled to the control circuit, the resonant circuit and the backlight source, and is utilized for providing an impedance according to the control signal to thereby adjust a current value of the backlight source.

According to another embodiment of the present invention, a driving method of a backlight module includes: generating an alternating current (AC) signal having a fixed frequency; generating an oscillation signal to drive a backlight source according to the AC signal; providing a control signal; providing an adjusting circuit and connecting the adjusting circuit to the backlight source; and providing an impedance according to the control signal to thereby adjust a current value of the backlight source.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
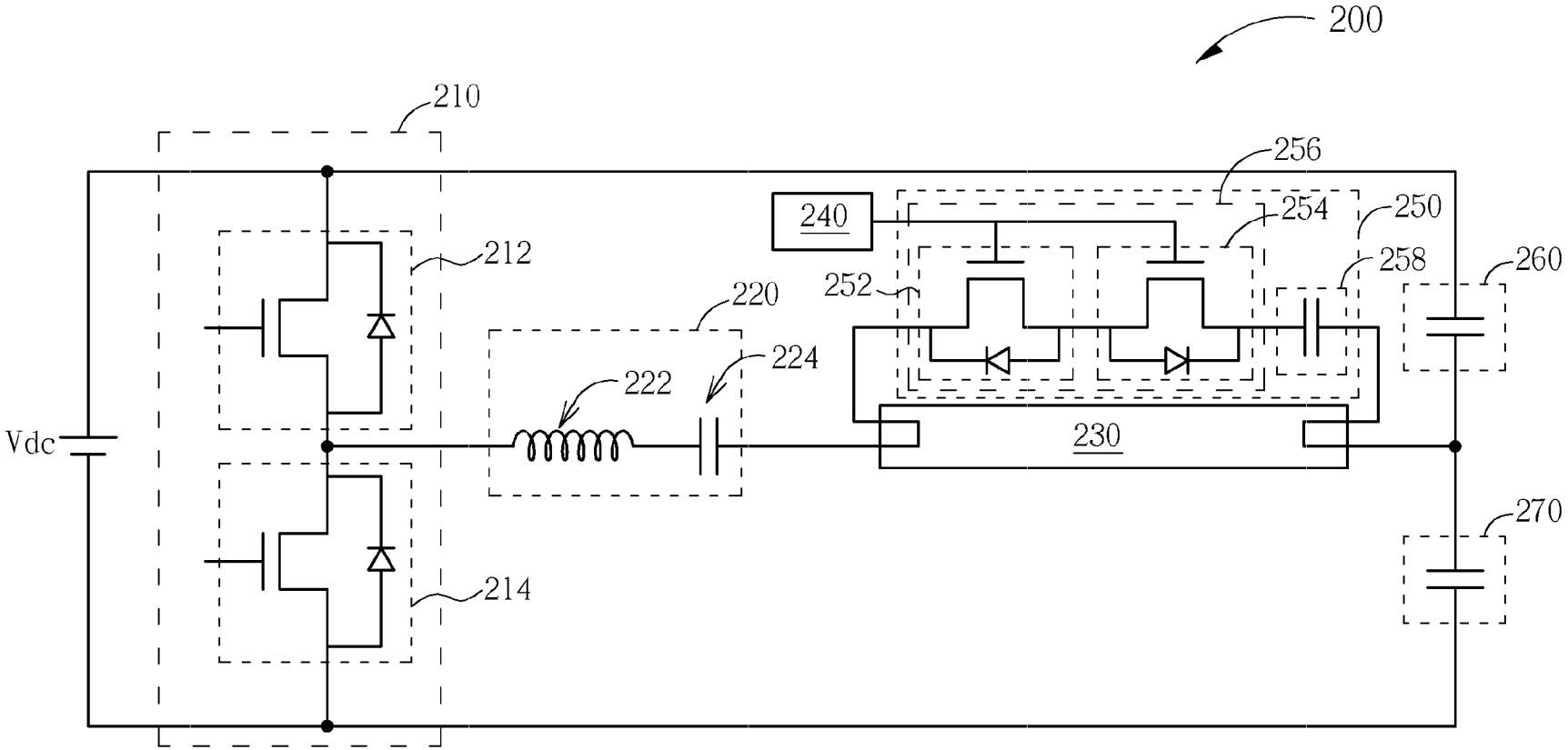
FIG. 2 is a diagram illustrating a quasi-half-bridge frequency-fixed driving circuit according to a first embodiment of the present invention.

Please refer to FIG. 2. FIG. 2 is a diagram illustrating a quasi-half-bridge frequency-fixed driving circuit 200 according to a first embodiment of the present invention. In this embodiment, the driving circuit 200 includes a DC voltage source Vdc, a signal generator 210, a resonant circuit 220, a control circuit 240, an adjusting circuit 250 coupled to the control circuit 240, the resonant circuit 220 and a backlight source 230, and two capacitors 260 and 270 coupled to the signal generator 210 and the backlight source 230. The signal generator 210 is used to generate an AC signal having a fixed frequency. The resonant circuit 220 is used to generate an oscillation signal to drive the backlight source 230 according to the AC signal. The control circuit 240 is used to generate a control signal. The adjusting circuit 250 is used to provide an impedance according to the control signal to thereby adjust a current value of the backlight source 230. The capacitors 260 and 270 are used to provide a DC voltage level. In addition, the signal generator 210 includes two transistors 212 and 214, and the AC signal having the fixed frequency can be generated by switching between the transistors 212 and 214. The resonant circuit 220 includes an inductor 222 and a capacitor 224, which is used to convert the AC signal generated from the signal generator 210 into a sinusoidal signal to drive the backlight source 230. The adjusting circuit 250 includes a bi-directional switch 256 and a capacitor 258, where the bi-directional switch 256 is implemented by two transistors 252 and 254.

As shown in FIG. 2, the capacitor 258 is series-connected to the bi-directional switch 256, and the capacitor 258 and the bi-directional switch 256 are parallel-connected to the backlight source 230. When the signal generator 210 generates the AC signal having the frequency $\omega_1$ and the bi-directional switch 256 is enabled (switched on), an impedance of the capacitor 258 is $(1/\omega_1 C_f)$, where $C_f$ is a capacitance of the capacitor 258. In this embodiment, the impedance of the capacitor 258 (1/ω1Cf) is designed to be far less than an impedance of the backlight source 230. Therefore, when the bi-directional switch 256 is enabled, the adjusting circuit 250 is in a main current path, and the backlight source 230 has a minimum luminance. When the bi-directional switch 256 is disabled (switched off), the backlight source 230 is in the main current path, and the backlight source 230 has a maximum luminance.

The prior art frequency-varied driving circuit 100 adjusts the luminance of the backlight source by directly adjusting the current of the backlight source. Compared with the prior art driving circuit 100, in the embodiment of the present invention, the backlight source 230 only has two possible currents respectively representing the maximum and minimum luminance of the backlight source 230. Therefore, the luminance-adjusting method of the present invention is to control a ratio between an enabling period and a disabling period of the bi-directional switch 256 by the control circuit 240, where this ratio is also meant to be a ratio between periods where the backlight source 230 respectively has the maximum and minimum luminance. For example, if a half-maximum luminance of the backlight source 230 is required, the control circuit 240 controls the ratio between the enabling and disabling period to be 1:1, that is, the ratio between periods where the backlight source 230 respectively has the maximum and minimum luminance is also 1:1, and a person can feel this required luminance due to visual fatigue.

Figure 1:
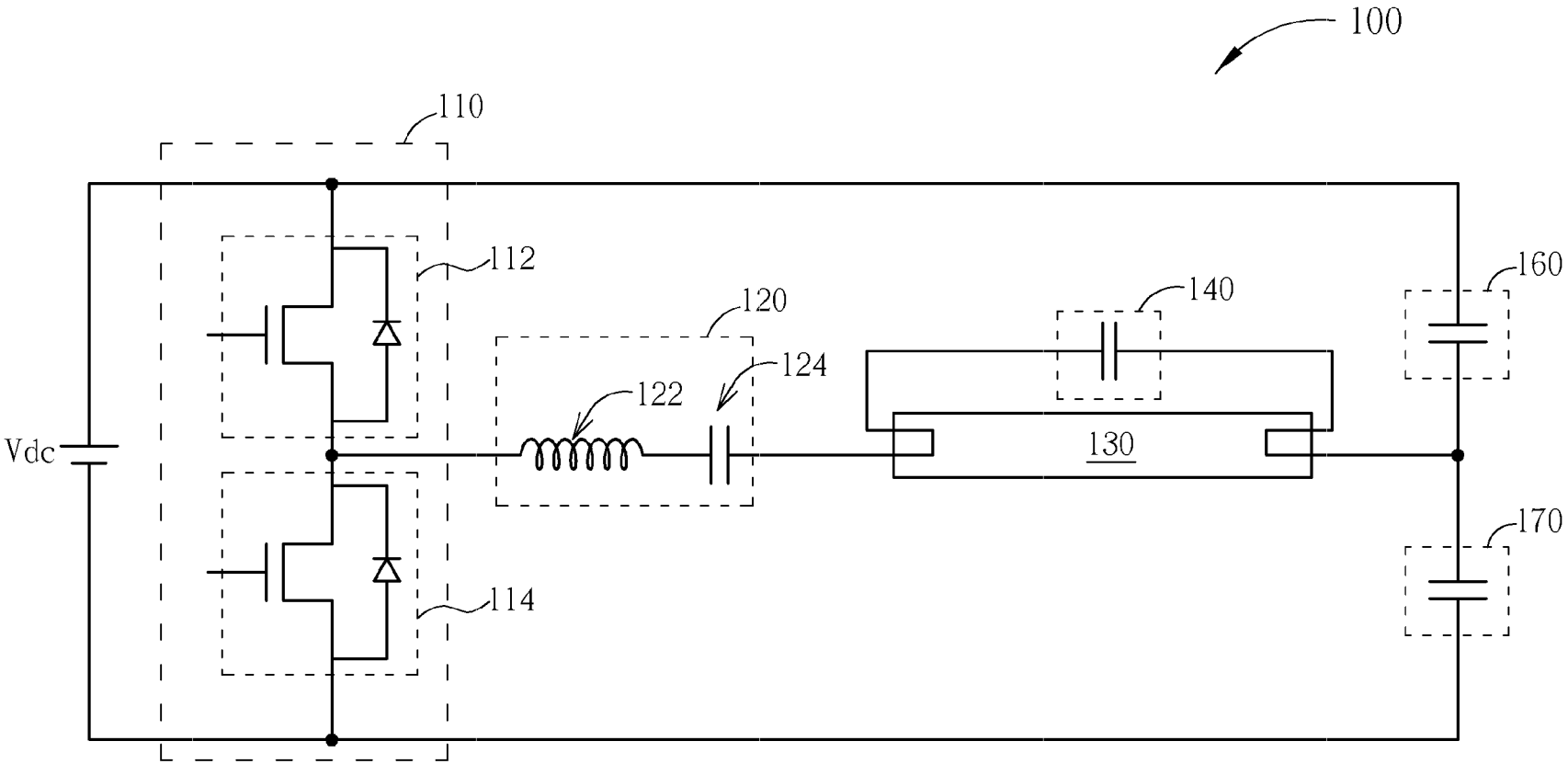
FIG. 1 PRIOR ART
FIG. 1 is a diagram illustrating a prior art quasi-half-bridge frequency-varied driving circuit.

The driving circuit 200 is similar to the prior art frequency-varied driving circuit shown in FIG. 1, and both have simple circuit structures. Because the AC signal generated from the signal generator 210 has the fixed frequency, the driving circuit 200 will not be influenced by electro-magnetic interference, and a design and an application of the magnetic components are more efficient. In addition, because of a frequency limitation of the AC signal generated from the signal generator, the impedance of the capacitor 140 of the frequency-varied driving circuit 100 is limited, causing a limited luminance-adjusting range. The frequency-fixed driving circuit 200 has a wider luminance-adjusting range, however, because the luminance of the backlight source is determined according to the ratio between the enabling and disabling period of the bi-directional switch.

Figure 3:
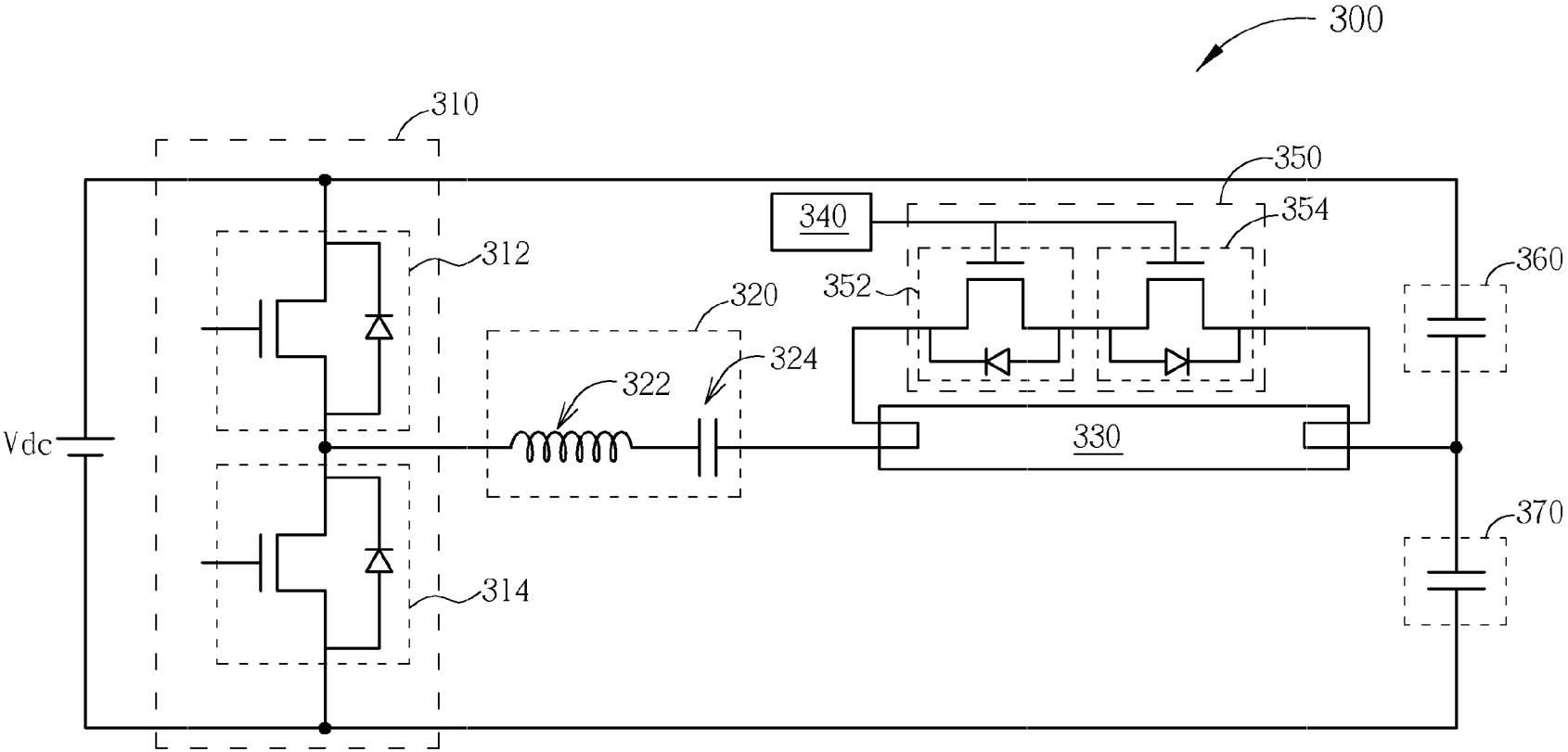
FIG. 3 is a diagram illustrating a quasi-half-bridge frequency-fixed driving circuit according to a second embodiment of the present invention.

Please refer to FIG. 3. FIG. 3 is a diagram illustrating a quasi-half-bridge frequency-fixed driving circuit 300 according to a second embodiment of the present invention. In this embodiment, the driving circuit 300 includes a DC voltage source Vdc, a signal generator 310, a resonant circuit 320 coupled to the signal generator 310, a control circuit 340, an adjusting circuit 350 coupled to the control circuit 340, the resonant circuit 320 and a backlight source 330, and two capacitors 360 and 370. The signal generator 310 is used to generate an AC signal having a fixed frequency. The resonant circuit 320 is used to generate an oscillation signal according to the AC signal to drive the backlight source 330. The control signal 340 is used to provide a control signal. The adjusting circuit 350 is used to provide an impedance according to the control signal. The capacitors 360 and 370 are used to provide a DC voltage level. In addition, the signal generator 310 includes two transistors 312 and 314, and the AC signal having the fixed frequency can be determined by switching between the transistors 312 and 314. The resonant circuit 320 includes an inductor 322 and a capacitor 324, which is used to convert the AC signal generated from the signal generator 310 into a sinusoidal signal to drive the backlight source 330. The adjusting circuit 350 includes two transistors 352 and 354 and serves as a bi-directional switch.

Figure 4:
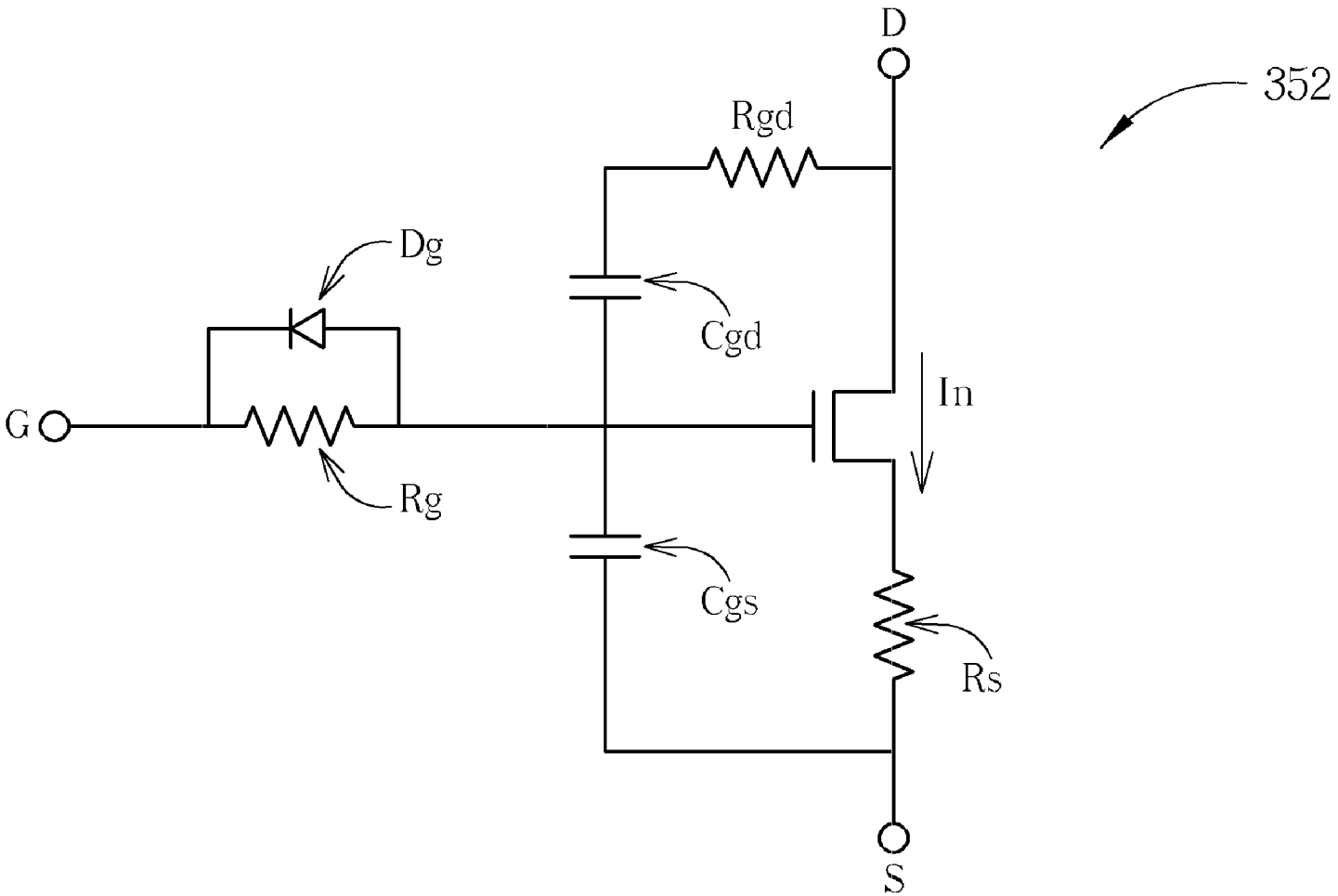
FIG. 4 is a diagram of an equivalent circuit of the transistor serving as a variable resistor.
Figure 5:
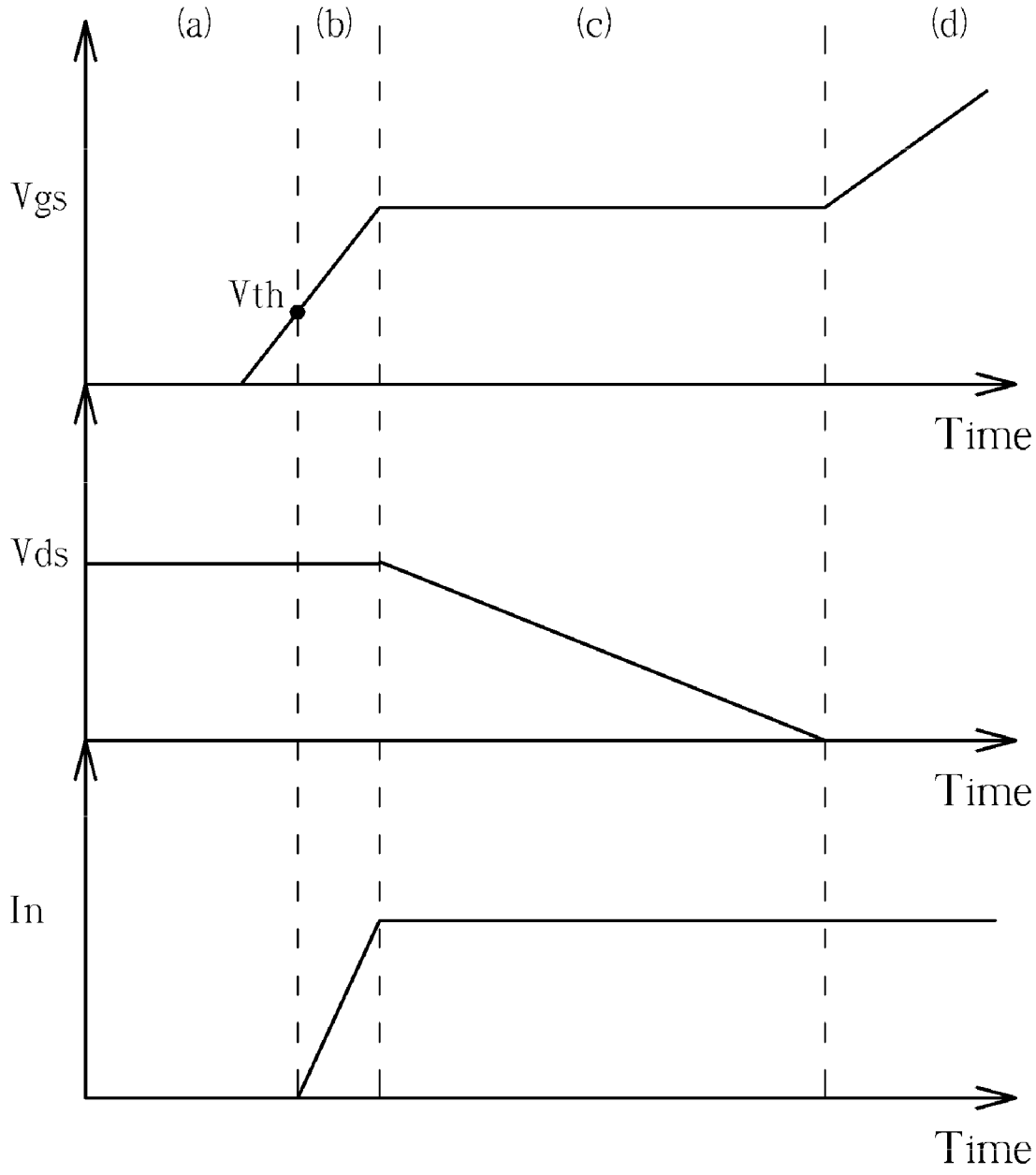
FIG. 5 is a diagram illustrating characteristics of the operations of the transistor shown in FIG. 4.

As shown in FIG. 3, the adjusting circuit 350 is the bi-directional switch, and one of two transistors in the bi-directional switch is designed as a variable resistor. Please refer to FIG. 4. FIG. 4 is a diagram of an equivalent circuit of the transistor 352 shown in FIG. 3. It is noted that the equivalent circuit of the transistor 352 is for illustrative purposes only, and is not meant to be a limitation of the present invention. As shown in FIG. 4, the equivalent circuit of the transistor 352 includes a gate electrode G, a drain electrode D and a source electrode S, a gate resistor Rg, a diode Dg, a resistor Rgd between the gate electrode and drain electrode, a capacitor Cgd between the gate electrode and drain electrode, a capacitor Cgs between the gate electrode and source electrode, and a resistor Rs. The characteristics of the operations of the transistor 352, which are relationships respectively between time and a voltage Vgs between the gate electrode and the source electrode, a voltage Vds between the drain electrode and the source electrode, and a current In between the drain electrode and the source electrode, are illustrated in FIG. 5. First, when the transistor 352 is activated during a period (a) shown in FIG. 5, because the voltage Vgs is not greater than a threshold voltage Vth of the transistor 352, there is no current between the drain electrode and the source electrode, and the voltage Vds remains constant. As the voltage Vgs gradually rises over the threshold voltage Vth (during a period (b) in FIG. 5), the current In is generated. Then, due to a constant current In between the drain electrode and the source electrode, the voltage Vds continues decreasing until it is equal to zero as shown in a period (c) in FIG. 5. In addition, because a resistor Rds between the drain electrode and the source electrode is a ratio between the voltage Vds and the current In, the resistor Rds is variable during period (c). Finally, during period (d), the voltage Vds and the current In remains constant.

In the frequency-fixed driving circuit 300 shown in FIG. 3, when the control circuit 340 disables the transistors 352 and 354, the adjusting circuit 350 has a very large impedance, and the backlight source 330 is in the main current path. At this time, the backlight source 330 has the maximum luminance. When the control circuit 340 enables the transistors 352 and 354, the adjusting circuit 350 has a lower impedance, and the adjusting circuit 350 is in the current path, and the backlight source 330 has the minimum luminance. In this embodiment, when the control circuit 340 controls the transistors 352 or 354 to operate as the variable resistor, the current of the backlight source 330 can be determined by a ratio between the impedance of the adjusting circuit 350 and the impedance of the backlight source 330 to thereby control the luminance.

The driving circuit 300 is similar to the prior art frequency-varied driving circuit 100 shown in FIG. 1 and the frequency-fixed driving circuit 200 shown in FIG. 2, and all of them have simple circuit structures. In addition, as described in the embodiment shown in FIG. 2, the driving circuit 300 will not be influenced by electro-magnetic interference, and the design and the application of the magnetic components are more efficient. Similarly, in the driving circuit 300, the control circuit 340 controls the impedance of the bi-directional switch (adjusting circuit 350), where a range of the impedance of the bi-directional switch is from a value (e.g., 10 micro-ohms) to a nearly unlimited value. Therefore, the frequency-fixed driving circuit 300 has a wider luminance-adjusting range.

Those skilled in the art will readily observe that numerous modifications and alterations of the device and method may be made while retaining the teachings of the invention.

What is claimed is:

1. A driving circuit of a backlight module, comprising:
a signal generator, for generating an alternating current (AC) signal having a fixed frequency;
a resonant circuit, coupled to the signal generator, for generating an oscillation signal to drive a backlight source according to the AC signal;
a control circuit, for providing a control signal; and
an adjusting circuit, coupled to the control circuit, the resonant circuit, and the backlight source, for providing an impedance according to the control signal to thereby adjust a current value of the backlight source;
wherein the adjusting circuit comprises a bi-directional switch, and the control circuit outputs the control signal to adjust an enabling/disabling period of the bi-directional switch.

2. The driving circuit of claim 1, wherein the adjusting circuit is connected in parallel to the backlight source.

3. The driving circuit of claim 1, wherein the control signal is further utilized to adjust an impedance of the bi-directional switch when the bi-directional switch is enabled.

4. The driving circuit of claim 1, wherein the adjusting circuit further comprises:
a capacitor connected in series to the bi-directional switch.

5. The driving circuit of claim 4, wherein an impedance of the bi-directional switch is a constant value when the bi-directional switch is enabled.

6. The driving circuit of claim 4, wherein an impedance of the capacitor is less than an impedance of the backlight source.

7. The driving circuit of claim 1, wherein the backlight source is a hot cathode fluorescent lamp.

8. A driving method of a backlight module, comprising:
generating an alternating current (AC) signal having a fixed frequency;
generating an oscillation signal to drive a backlight source according to the AC signal;
providing a control signal;
providing an adjusting circuit and connecting the adjusting circuit to the backlight source; and
providing an impedance according to the control signal to thereby adjust a current value of the backlight source;
wherein the step of providing the adjusting circuit comprises:
positioning a bi-directional switch in the adjusting circuit; and
the step of providing the control signal comprises:
setting the control signal to adjust an enabling/disabling period of the bi-directional switch.

9. The driving method of claim 8, wherein the step of connecting the adjusting circuit to the backlight source comprises:
connecting the adjusting circuit and the backlight source in parallel.

10. The driving method of claim 8, wherein the step of proving the control signal further comprises:
setting the control signal to adjust an impedance of the bi-directional switch when the bi-directional switch is enabled.

11. The driving method of claim 8, wherein the step of providing the adjusting circuit further comprises:
connecting a capacitor and the bi-directional switch in series.

12. The driving method of claim 11, wherein the step of providing the control signal further comprises:
setting the control signal to make an impedance of the bi-directional switch be a constant value when the bi-directional switch is enabled.

13. The driving method of claim 11, wherein the step of providing the adjusting circuit further comprises:
setting an impedance of the capacitor to be less than an impedance of the backlight source.

14. The driving method of claim 8, wherein the backlight source is a hot cathode fluorescent lamp.

* * * * *